US006227128B1

(12) United States Patent
Tomita et al.

(10) Patent No.: US 6,227,128 B1
(45) Date of Patent: May 8, 2001

(54) SEWING MACHINE HAVING A DISPLAY

(75) Inventors: Shintaro Tomita; Akira Hayakawa, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/605,539

(22) Filed: Jun. 29, 2000

(30) Foreign Application Priority Data

Jul. 29, 1999 (JP) ..... 11-215162

(51) Int. Cl.[7] ..... D05B 21/00; D05C 5/02

(52) U.S. Cl. ..... 112/102.5; 112/445; 112/475.19; 700/138

(58) Field of Search ..... 112/470.01, 102.5, 112/470.06, 475.19, 445, 456, 458; 700/136, 137, 138

(56) References Cited

U.S. PATENT DOCUMENTS 5,156,107 * 10/1992 Kyuno ..... 112/445
5,784,986 * 7/1998 Morita ..... 112/102.5
5,791,270 * 8/1998 Mori ..... 112/102.5
6,119,611 * 9/2000 Tomita ..... 112/470.04

* cited by examiner

*Primary Examiner*—Peter Nerbun
(74) *Attorney, Agent, or Firm*—Oliff & Berridge, PLC

(57) ABSTRACT

In the sewing machine, a sewing device forms an embroidery pattern on a work cloth in cooperation with a moving mechanism. A display switching device switches the display between a first display mode and a second display mode. Therefore, the sewing machine can selectively display the size value representing a size of the embroidery pattern or the position value representing a position of the embroidery pattern on the work cloth using the display as desired. Further the display is necessary to secure a space for displaying both the size value and the position value at once. Accordingly, the sewing machine display can be downsized without sacrificing the convenience of the display.

15 Claims, 9 Drawing Sheets

SEWING MACHINE HAVING A DISPLAY

BACKGROUND OF THE INVENTION

1. Field of Invention

The invention relates to a sewing machine having a display for displaying a sewing pattern.

2. Description of Related Art

There has been proposed an embroidery sewing machine that includes a sewing device that forms stitches on a work cloth, a moving device that moves the position of the stitches, which are to be formed on the work cloth by the sewing device, one after another, by moving the work cloth relative to the sewing device based on sewing data, and a display device that displays an embroidery pattern to be formed on the work cloth by the cooperation between the sewing device and the moving device.

In such an embroidery sewing machine, the sewing device forms the stitches on a work cloth, and the moving device moves the work cloth relative to the sewing device. By the cooperation between the sewing device and the moving device, the stitches to be formed on the work cloth by the sewing device are changed one after another, whereby an embroidery pattern is formed on the work cloth. The display device displays the embroidery pattern, so that an user can observe and confirm the embroidery pattern to be formed on the work cloth prior to sewing.

When displaying the embroidery pattern on the display device, it is required that a size and a position on the work cloth of the embroidery pattern be displayed on the display device in numerical values, because the size and position are extremely important requirements to consider a balance between the embroidery pattern and the work cloth. Further, it is particularly important to display the position from the viewpoint of the technological advance described below.

Recently, in an embroidery sewing machine including a moving device that horizontally moves a work cloth held by an embroidery frame, it has been proposed to form a large embroidery pattern, which is larger in area than a moving range of the moving device, by changing a mounting position of the embroidery frame among three different positions, for example. Further, it has been proposed that a large embroidery pattern can be formed without changing the mounting position of the embroidery frame among three different positions by making improvements to the moving device so that the moving range of the moving device is expanded. In these cases, it is extremely important to display the position on the work cloth of the embroidery pattern on the display device. Recently, to display the position is particularly of increasing importance.

The display device of this type is for example structured by a liquid crystal display (LCD) provided on a surface of a standard portion of the sewing machine. Further, a touch panel may be structured by providing touch keys, which are transparent electrodes and are arranged on a grid on the LCD, and the position on the work cloth of the embroidery pattern may be changed by touching buttons on the touch panel by hand.

However, recently, a requirement to downsize the embroidery sewing machine has come into being and, therefore, the touch panel or the liquid crystal display (display device) must also be made smaller in size. Therefore, it is difficult to completely display the size and position on the work cloth of the embroidery pattern on the display device at one time.

SUMMARY OF THE INVENTION

The invention will be described in the context of an embroidery sewing machine having a display, that can selectively display a size value of an embroidery pattern or a position value of the embroidery pattern on a work cloth as desired so that the display can be downsized. However, the invention could be applied to any sewing machine for sewing structured patterns, such as buttonholes.

In this regard, the sewing machine of the described embodiment, which is an embroidery sewing machine, of the invention may include a sewing device that forms a stitch on a work cloth, a moving mechanism that moves the work cloth relative to the sewing device, a display that displays a sewing pattern, and a display switching device that switches the display between a first display mode and a second display mode, a size value that represents a size of the sewing pattern being displayed in the first display mode, and a position value that represents a position of the sewing pattern on the work cloth being displayed in the second display mode.

According to the sewing machine structured as described above, the sewing device forms a pattern on a work cloth in cooperation with the moving mechanism. The display switching device switches the display between a first display mode and a second display mode. Therefore, the sewing machine can selectively display the size value representing a size of the sewing pattern or the position value representing a position of the sewing pattern on the work cloth using the display as desired. Further, the display is necessary to secure a space for displaying both the size value and the position value at once. Accordingly, the sewing machine and the display can be downsized at the same time the convenience of the display is maintained.

In a preferred aspect of the invention, the size value and the position value may be displayed on substantially the same part of the display. According to the sewing machine structured as described above, the space of the display can be used efficiently, thereby the sewing machine and the display can be further downsized.

In a preferred aspect of the invention, the display displays a distinguishable mark along with at least one of the size value or the position value so that the size value and the position value can be distinguished. According to the sewing machine structured as described above, an operator can surely distinguish at a glance whether the size value is displayed or the position value is displayed referring to the distinguishable mark. Therefore, the display can prevent the user from mixing up the values and the operability of the sewing machine can be increased.

In a preferred aspect of the invention, the display switching device further switches the display to a third display mode, both the size value and the position value are displayed on the display in the third display mode. According to the sewing machine structured as described above, when the operator desires to confirm both the size value and the position value at the same time, the sewing machine switches the display to the third display mode, in which both the size value and the position value are displayed, using the display switching device. Therefore, the operability of the sewing machine can be further increased.

In a preferred aspect of the invention, the display comprises a touch key panel, at least one button key is displayed on a predetermined area of the touch key panel, the size value and the position value are displayed on the predetermined area without displaying the button key in the third display mode. According to the sewing machine structured as described above, the operator can easily operate the sewing machine with touching button keys provided on the touch key panel. Further, the display can be further downsized. In addition, in the third display mode, the size value and the position value are displayed on the predetermined area for at least one button key which is not used. Therefore, the display of the size value and the position value does not need to be scaled down and the visibility of the values can be maintained in the third display mode. Accordingly, the sewing machine and the display can be further downsized.

BRIEF DESCRIPTION OF THE DRAWINGS

A preferred embodiment of the invention will be described in detail with reference to the following figures wherein.

DETAILED DESCRIPTION OF PREFERRED EMBODIMENT

A preferred embodiment of the invention will be described with reference to the accompanying drawings. The embodiment of the invention is an example of the invention being applied to an electronically-controlled embroidery sewing machine M that enables the sewing of not only utility stitch patterns but also various embroidery patterns by use of a detachable embroidery, or work, frame driving device.

Figure 1:
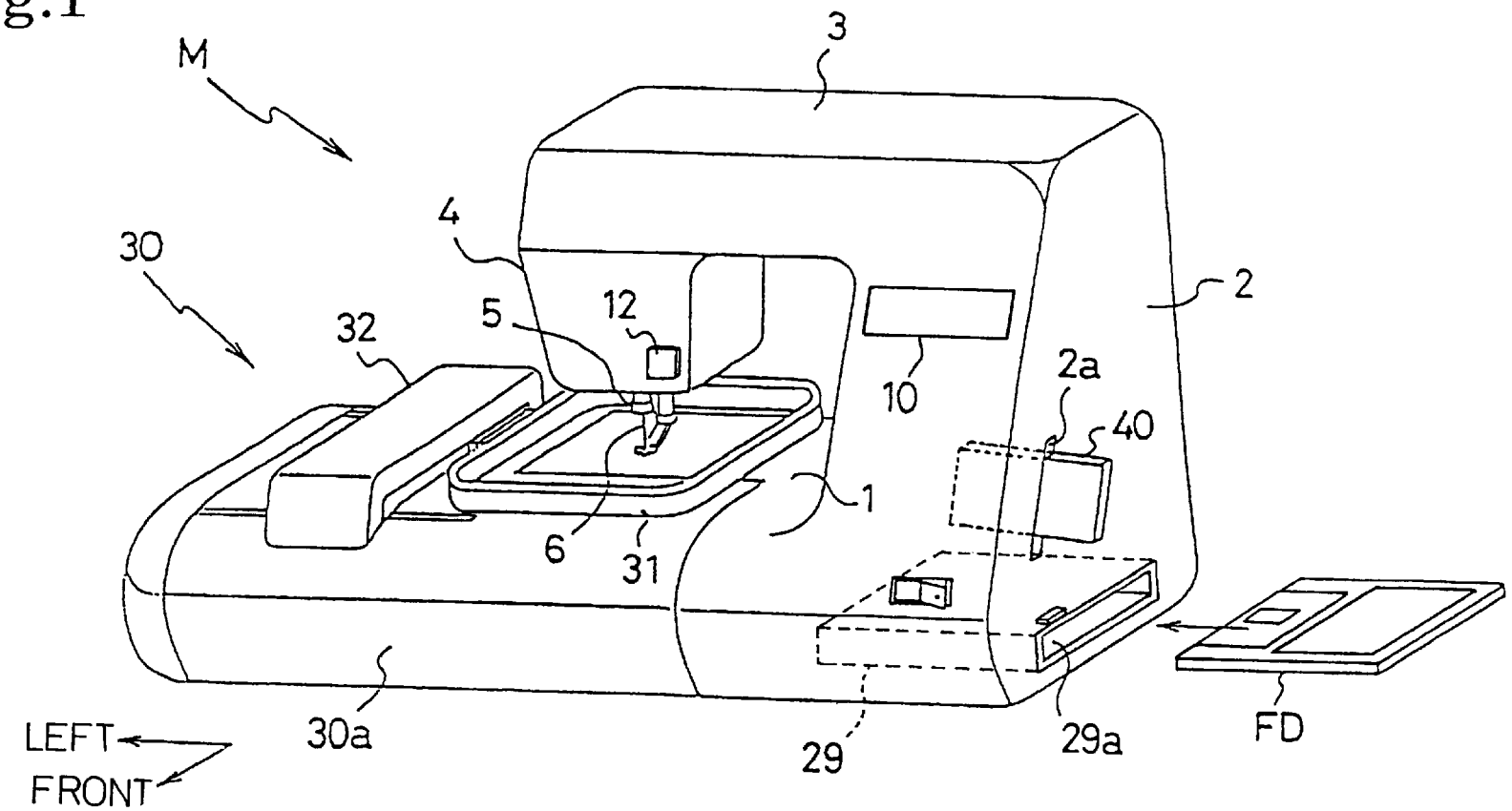
FIG. 1 is a perspective view showing the appearance of an embroidery sewing machine according to an embodiment of the invention.

As shown in FIG. 1, the embroidery sewing machine M has a bed 1, a standard portion 2 that stands on the right of the bed 1, and an arm 3 extending from the upper part of the standard portion 2 toward the left parallel to the bed 1.

The bed 1 includes a feed dog up and down moving mechanism (not shown) that moves a feed dog up and down, a feed dog back and forth moving mechanism (not shown) that moves the feed dog back and forth, and a thread loop taker (e.g. a vertical axis oscillating shuttle not shown) that contains a lower thread bobbin and cooperates with a needle 6. On the side of the standard portion 2, there are a slot 2*a* for a card into which a ROM card 40 having a large amount of pattern data can be inserted (sewing data and pattern display data) to be connected to an internal connector 13 for the card (see FIG. 2) and a slot for a disk 29*a* into which a floppy disk (FD) is inserted to be mounted in a disk driving device 29 (FDD) (see FIG. 2).

That is, the FDD 29 is provided in the standard portion 2 and is protected from dust, such as lint, produced from a work cloth at the time of sewing. Insertion slot 29*a* into which the disk FD is removably inserted is disposed at the right surface of the standard portion 2 (as shown in FIG. 1). An indicator lamp (not shown) for indicating a mounting condition or an access condition of the disk FD is provided to the insertion slot 29*a*. However, a user cannot see the indicator lamp during the sewing operation.

The arm 3 includes a needle bar driving mechanism (not shown) that moves a needle bar 5, having the needle 6 at the bottom, up and down, a needle bar swinging mechanism (not shown) that swings the needle bar 5 in the direction perpendicular to a feed direction of a work cloth, a thread take-up driving mechanism (not shown) that moves a thread take-up in accordance with the up and down movement of the needle bar 5. The feed dog up and down moving mechanism, the needle bar driving mechanism and the thread take-up driving mechanism are driven by a machine motor 17, the needle bar swinging mechanism is driven by a stepping motor 18 for swinging the needle bar 5, and the feed dog back and forth moving mechanism is driven by a stepping motor 19 for driving the feed dog back and forth (see FIG. 2). A machine head 4 of the arm 3 has a start/stop switch 12 that orders a start of and an end to the sewing operation.

Inside a translucent cover (an operating member) of the start/stop switch 12, a color LED 12*a* (which corresponds to a indicator lamp) is mounted which is a combined red-emitting LED and a green-emitting LED. When the embroidery sewing machine M is in a condition where it is impossible to sew an embroidery pattern, such that a presser foot is lifted, the red-emitting LED illuminates, so that the color LED 12*a* illuminates in red. When the embroidery sewing machine M is in a condition where it is possible to wind a bobbin thread, the red- and green-emitting LEDs illuminates, so that the color LED 12*a* illuminates in orange. When the embroidery sewing machine M is in a condition where it is possible to sew an embroidery pattern, the green-emitting LED illuminates, so that the color LED 12*a* illuminates in green.

On the front of the standard portion 2, a color liquid crystal display 10 (hereinafter referred to as an LCD) is provided. The LCD 10 displays stitch types, pattern names, function names, and various messages assigned in utility stitch patterns and embroidery patterns. A plurality of touch keys 11, which are transparent electrodes and correspond to function names and pattern names based on the displayed screen, are arranged on a grid on the LCD 10. Thus, LCD 10 and the touch keys 11 constitute a touch panel, and selection of a desired embroidery pattern or an order of a function can be realized simply by pressing a corresponding touch key 11.

On the left end of the bed 1, a free bed, generally known as a free arm, is where an embroidery, or work, frame driving mechanism 30 is detachably mounted.

The embroidery frame driving mechanism 30 has a housing 30*a*, an embroidery frame 31 that can detachably hold a work cloth, a Y-axis direction driving part 32 including a Y-axis direction moving mechanism that moves the embroidery frame 31 in the Y-axis direction (back and forth), and an X-axis direction moving mechanism that is contained in the housing 30a and moves the Y-axis direction driving part 32 in the X-axis direction (right and left). The X-axis direction moving mechanism is driven by a first stepping motor 33 and the Y-axis direction moving mechanism is driven by a second stepping motor 34 (see FIG. 2).

When the embroidery frame driving mechanism 30 is attached to the bed 1, the first and second stepping motors 33, 34 are electrically connected to a controller C on the embroidery sewing machine M via a connector 14. The controller C controls the operation of the stepping motors 33, 34, and the embroidery, or work, frame 31, in which a work cloth is set, is moved in the X- and Y-axis directions individually to perform an embroidering operation.

Next, the control system of the embroidery sewing machine M will be described.

Figure 2:
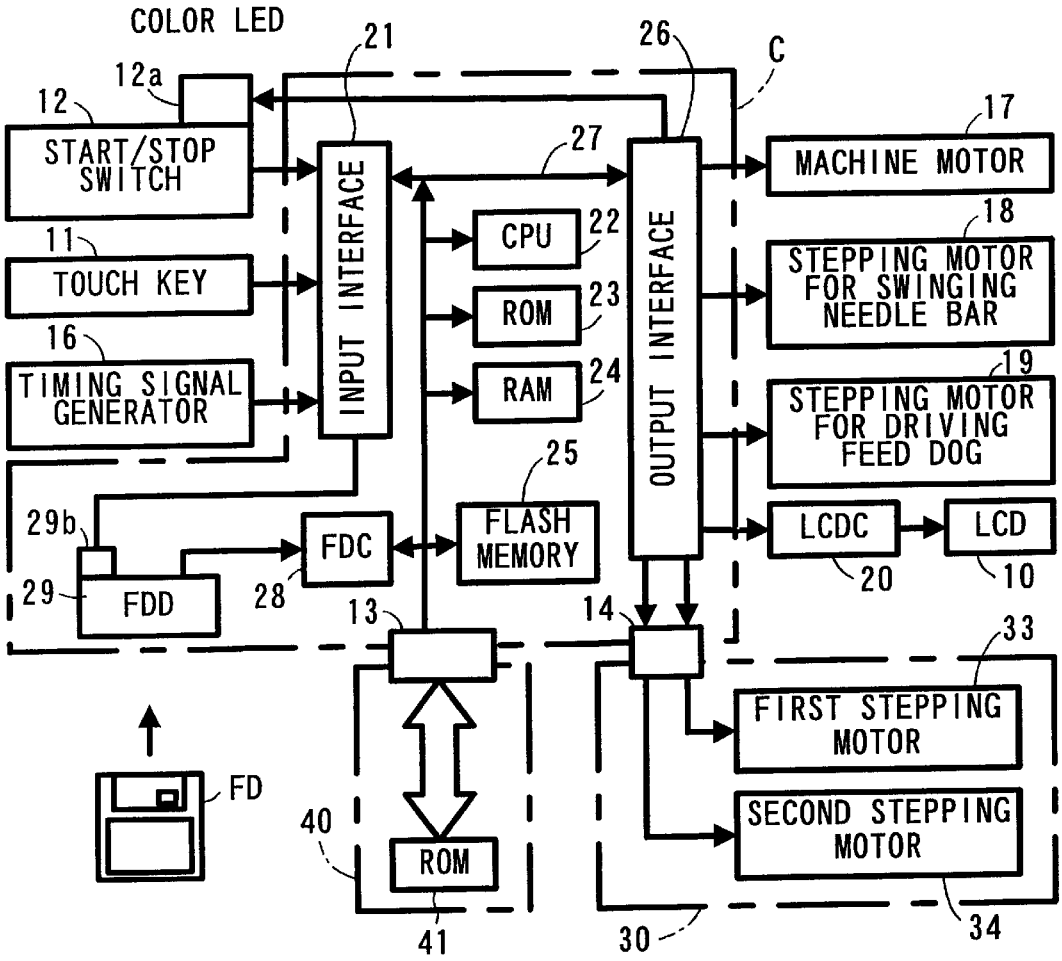
FIG. 2 is a block diagram showing a structure of a control system of the embroidery sewing machine.

As shown in FIG. 2, the controller C comprises an input interface 21, a computer including a CPU 22, a ROM 23, a RAM 24, a flash memory 25, that is nonvolatile and electrically rewritable, a floppy disk controller (FDC) 28 that drives the FDD 29, an output interface 26, and a bus 27 that serves to connect the various elements. The input interface 21 is connected to the start/stop switch 12, the touch keys 11, a timing signal generator 16 that detects a plurality of rotation phases of the sewing machine main shaft, and a FD sensor 29*b* that detects the presence or absence of the disk FD in the FDD 29.

The output interface 26 is connected to the color LED 12*a* provided in the start/stop switch 12, the motors 17, 18, 19 provided in the embroidery sewing machine M, a display controller (LCDC) 20 for the LCD 10, and the first and second stepping motors 33, 34 for the embroidery frame driving mechanism via the connector 14. The bus 27 is connected to the ROM 41 of the ROM card 40 via the connector for card 13 and to the FDC 28.

The ROM 23 has been prestored with general control programs for the sewing control required for sewing utility stitch patterns and display control, editing programs for editing a selected embroidery pattern by enlargement, reduction, and/or rotation via the LCD 10, an embroidering program for sewing a selected embroidery pattern, a pattern selection control program, and a control program for controlling a display condition of the LCD 10 as described later.

Further, the ROM 23 stores font data for the alphabet in 10 pt (approx. 3.6 mm), 15 pt (approx. 5.4 mm), and 27 pt (approx. 10 mm) to indicate text information, such as a pattern name, the number of stitches, and the number of colors. All font data are associated with alphabet code data.

Figure 3:
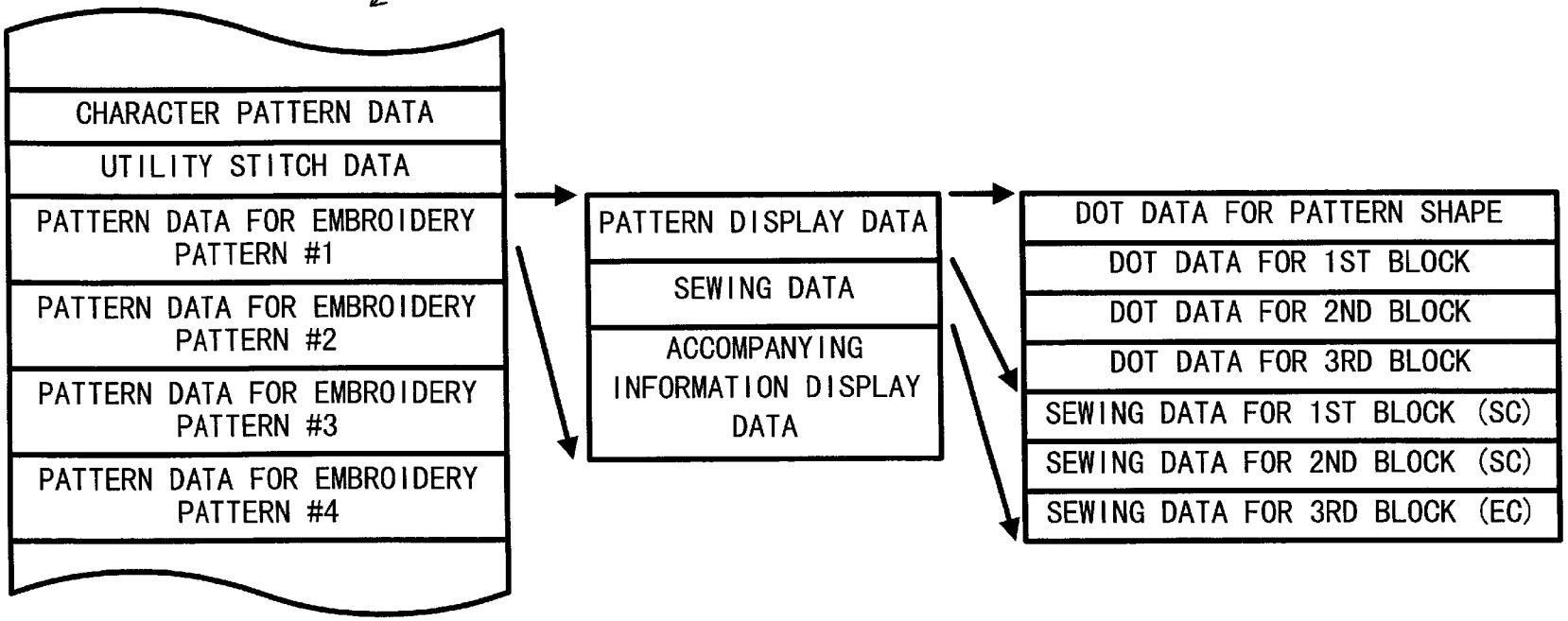
FIG. 3 shows the structure of the data stored in a pattern data memory of the control system.

As shown in FIG. 3, a pattern data memory 23*a* of the ROM 23 stores a plurality of pieces of data. One piece is character pattern data related to letters, symbols and numerals; another piece is embroidery pattern data including straight and zigzag stitches; and a further pattern data is embroidery pattern data which is often used relatively and divided into groups designated with numbers (like embroidery pattern no. 1, embroidery pattern no. 2, embroidery pattern no. 3).

The pattern data for each embroidery pattern has the same structure as the pattern data for any other embroidery pattern. For example, the pattern data for the embroidery data no. 1, as shown in FIG. 3, comprises pattern display data to display elements with a plurality of colors; sewing data required to perform embroidering; and accompanying information display data for displaying accompanying information, such as display data used for pattern selection as shown in FIG. 8, and display data which is displayed during embroidering and includes characters, numbers, and symbols, except for a selected embroidery pattern and blocks. All data is stored distinctively.

Figure 8A:
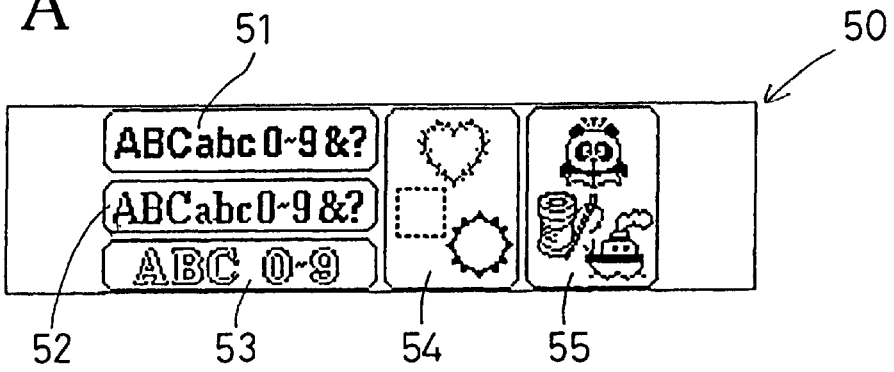
FIG. 8A shows an example of a pattern type selection screen.
Figure 8B:
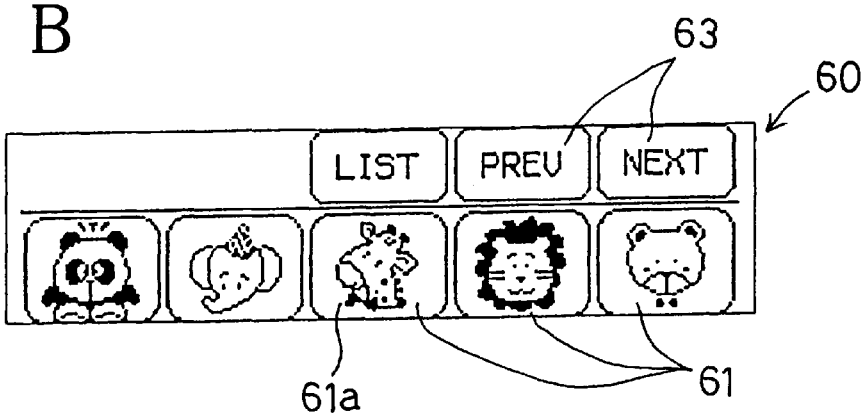
FIG. 8B shows an example of a pattern selection screen.
Figure 8C:
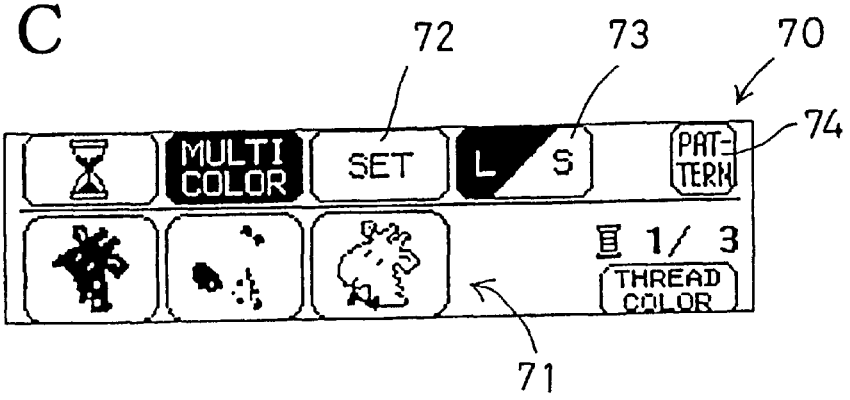
FIG. 8C shows an example of a pattern display screen.

For example, for the embroidery pattern "giraffe" 61*a*, shown in FIGS. 8B and 8C, dot data for the shape of the embroidery pattern "giraffe" (which is the display data corresponding to a pattern selection key 61*a*) and three blocks (which are the display data corresponding to an image display 71) are stored as the pattern display data for an embroidery pattern no. 1. As shown, when three colors are used for the embroidery pattern, three pieces of sewing data are stored, a piece for each block of three blocks. The accompanying information display data includes the display data for displaying characters and the function names on various display screens. The sewing data for each block also has stop code (SC) for thread change, and a sewing time. The sewing data for the last block also includes end code (EC) (see FIG. 3).

The ROM card 40 has a plurality of variations according to the pattern type. As with the ROM 23, the ROM 41 of the ROM card 40 stores a plurality of pieces of embroidery pattern data, such as embroidery pattern #1, embroidery pattern #2, embroidery pattern #3, that have a low frequency of use so that they are divided into groups using numbers (see FIG. 3).

In the RAM 24, a pattern name memory 24*a* stores a plurality of pattern names read from a disk FD. A sewing data memory 24*b* stores sewing data for a selected embroidery pattern. Further, RAM 24 includes memories required for each control required to accomplish what is described above (e.g., flag memory, pointer memory, counter memory, register, buffer).

Figure 4:
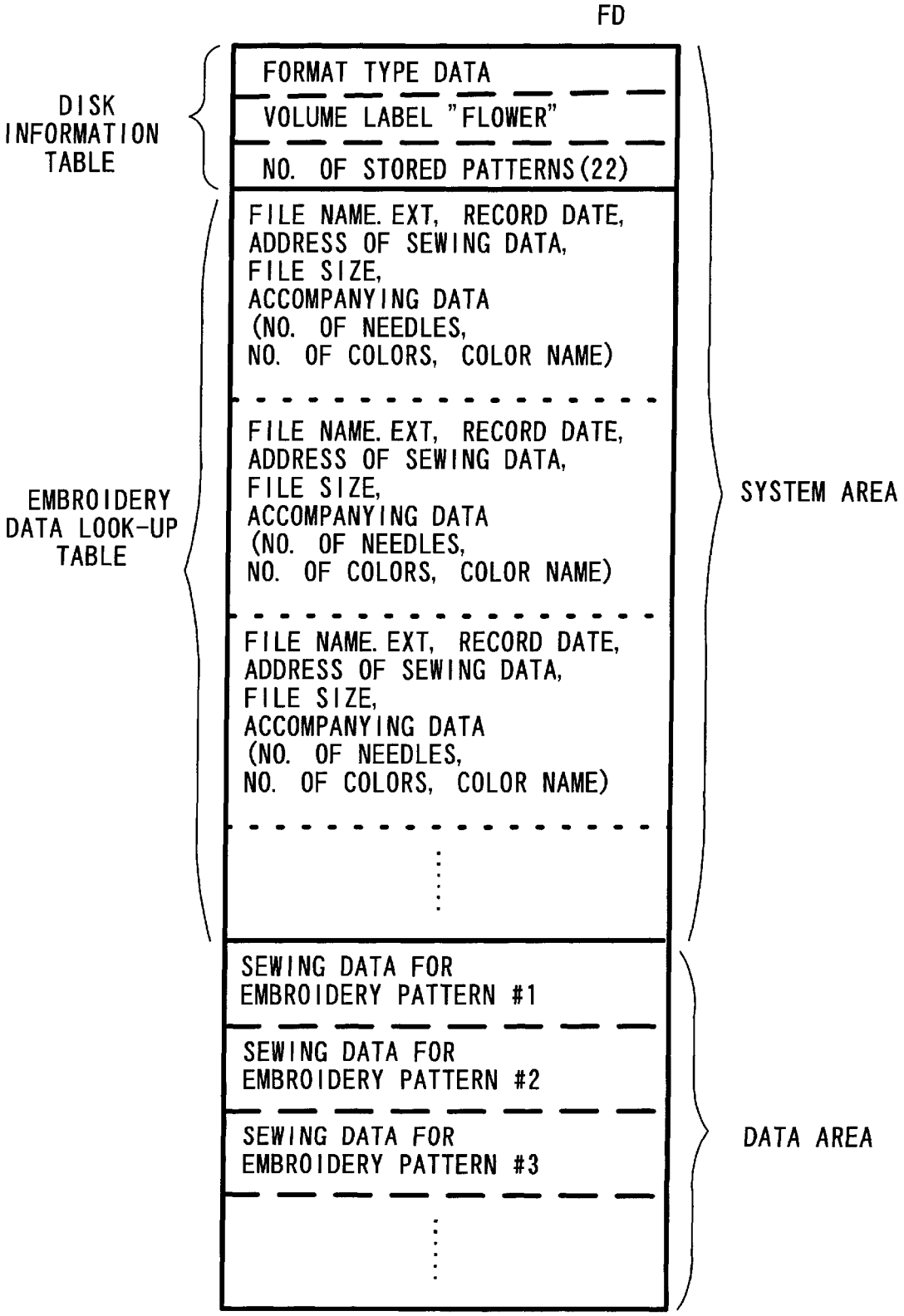
FIG. 4 shows a structure of the data stored in a floppy disk.

The disk FD stores various data in addition to sewing data for stitch formation as shown in FIG. 4.

Stored in a system area are a disk information table and a plurality of embroidery data look-up tables. The disk information table includes format type data that define the disk FD format, such as 2DD or 2HD, a volume label, e.g. "FLOWER", and the number of patterns stored, e.g. "22". In addition, each embroidery data look-up table includes a filename having a pattern name and an extension, a recording date, and address for embroidery data store in the data area, a file length, and accompanying data related to stitch formation. An extension like ".HUS" and ".PES" is attached to the end of a filename to indicate the type of file.

The accompanying data has information about the number of stitches to be sewn, the number of colors to be used, and color names for corresponding colors.

A data area includes sewing data required to form each embroidery pattern starting from the top address indicated by the sewing data storage address. If the sewing data is used to embroider a pattern with a plurality of colors, it includes stop codes that stop the needle for every color change.

Figure 5:
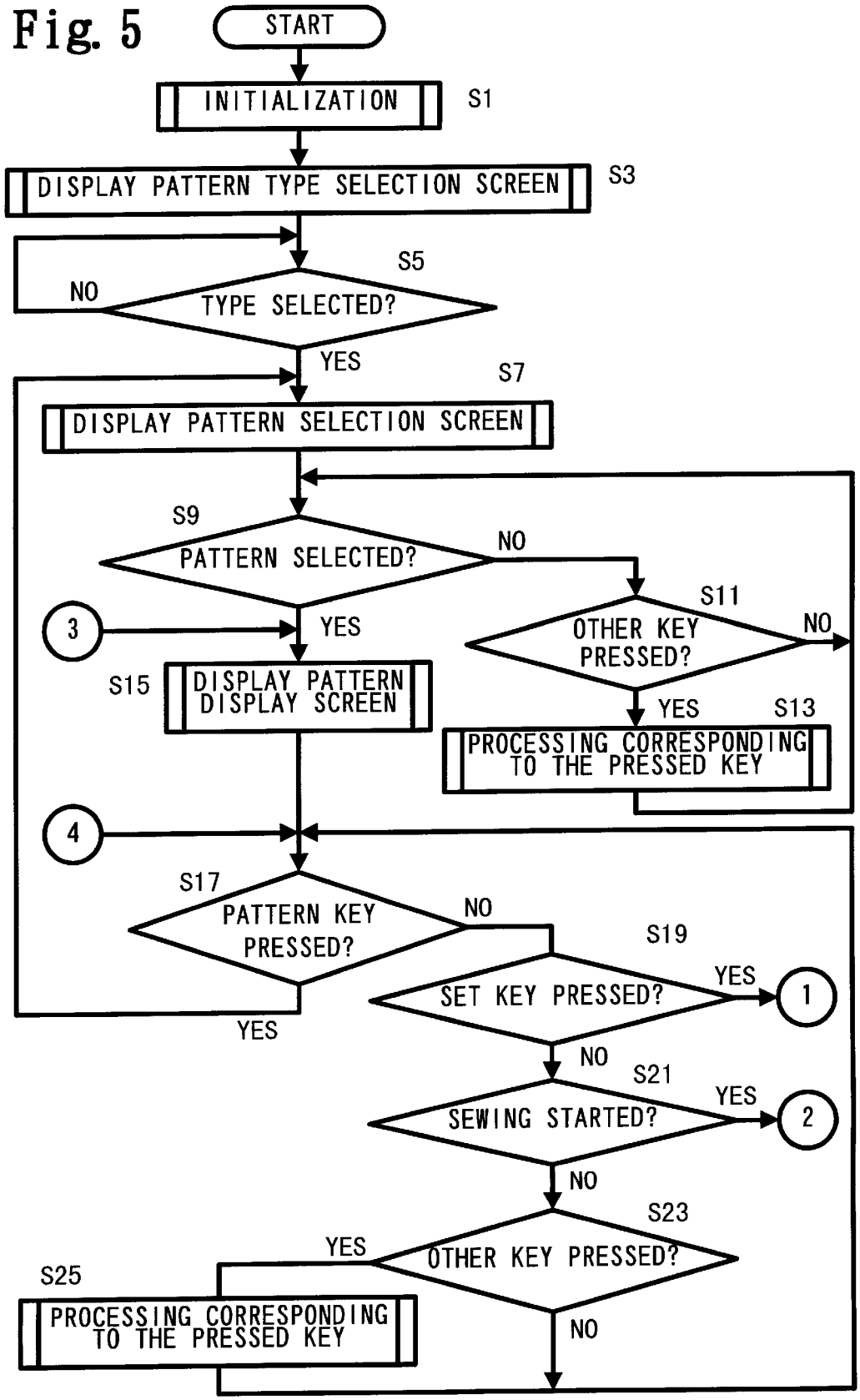
FIG. 5 is a flowchart showing a main routine executed by the control system.
Figure 6:
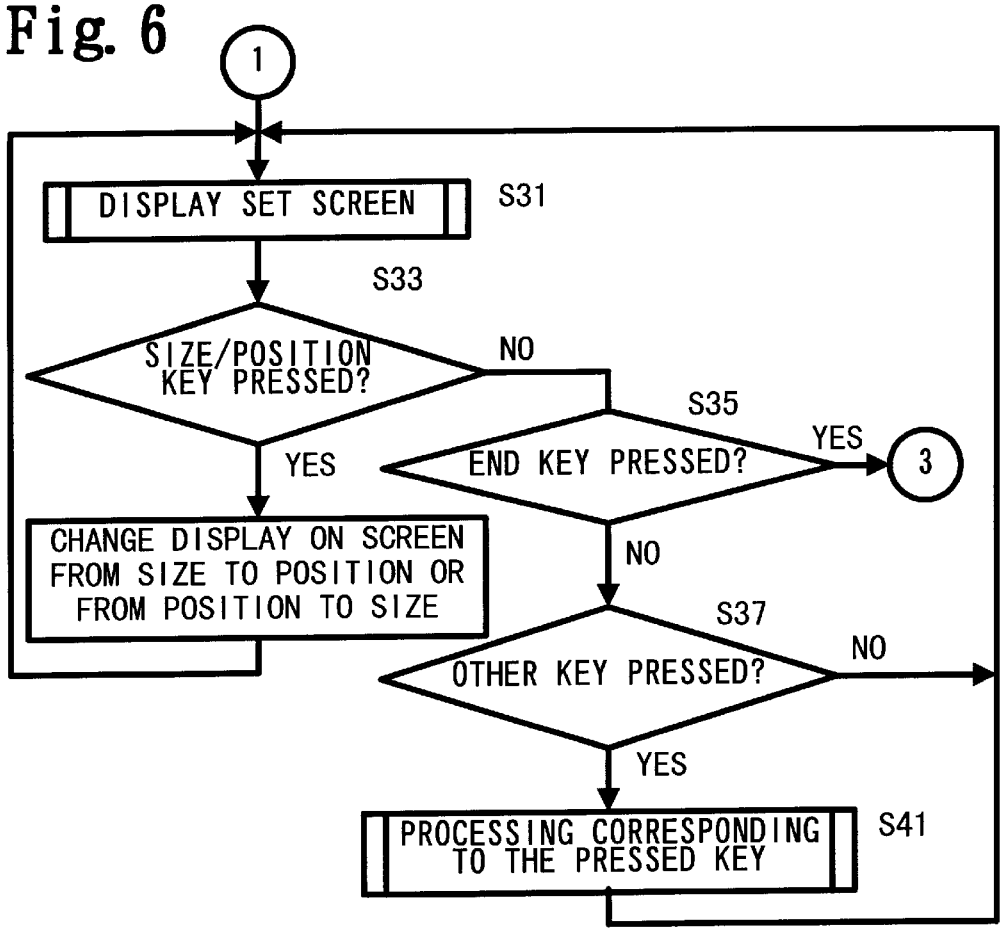
FIG. 6 is a flowchart showing the main routine following to the flowchart of FIG. 5.
Figure 7:
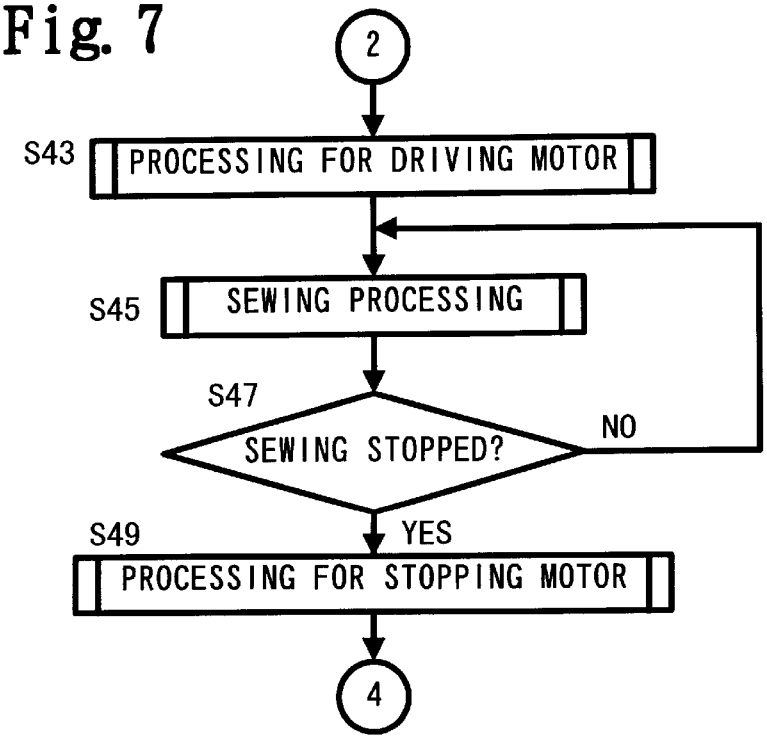
FIG. 7 is a flowchart showing the main routine following to the flowchart of FIG. 5.

Next, the processing executed in the controller C will be described with reference to FIGS. 5 through 7. In the flowcharts, Si (i=1, 2, 3 . . . ) stands for a step.

When the power is turned on, initialization, such as clearing each memory in the RAM 24, is performed (S1) and a pattern type selection screen 50, shown in FIG. 8A, is displayed (S3). As shown in FIG. 8A, using the pattern type selection screen 50, the type of embroidery pattern in selected. The pattern type selection screen 50 has a Gothic type character selection key 51 for selecting a Gothic type alphabet, a Mincho type character selection key 52 for selecting a Mincho type alphabet, an outline character selection key 53 for selecting an outline alphabet, a frame pattern selection key 54 for selecting a frame pattern, and a picture pattern selection key 55 for selecting a picture pattern.

At S5, the flow continues waiting until a pattern type is selected by pressing any of keys 51 through 55. When the pattern type is selected (S5:YES), the flow moves to S7 and a pattern selection screen 60 appears. For example, when the picture pattern selection key 55 is pressed on the pattern type selection screen 50, as shown in FIG. 8B, the pattern selection screen 60 is displayed to select a desired pattern from various picture patterns. The pattern selection screen 60 has pattern selection keys 61 schematically showing various picture patterns and page turning keys 63 for turning the page to the previous/next page to display other picture patterns. Further, when any one of the selection keys for alphabets or a frame pattern is selected on the pattern type selection screen 50, pattern selection keys for selecting alphabet characters or frames are displayed on the pattern selection screen 60 as is the case with selecting the picture pattern.

At S9, it is determined whether a pattern is selected by pressing any one of pattern selection keys 61. When a pattern is not selected (S9:NO), it is determined whether another key is pressed (S11). When no other key is pressed (S11:NO), the flow returns to S9. When another key is pressed (S11:YES), the processing corresponding to the function of the pressed key (e.g. turning the page to the previous/next page) is performed (Si 3) and then the flow returns to S9. When any one of the pattern selection keys 61 is pressed, and a pattern is selected, while the processing of S9 through S13 is repeated (S9:YES), the flow moves to S15 and a pattern display screen 70 is displayed.

For example, when a pattern selection key 61*a* corresponding to an embroidery pattern "giraffe" is pressed on the pattern selection screen 60, the pattern display screen 70 as shown in FIG. 8C is displayed. As shown in FIG. 8C, on the pattern display screen 70, is an image display 71 showing the selected embroidery pattern (the "giraffe" pattern in this embodiment), which is broken down according to thread color, and various kinds of keys, such as a SET key 72, an L/S key 73, and a PATTERN key 74, are displayed.

At S17, it is determined whether the PATTERN key 74 is pressed. When the PATTERN key 74 is not pressed (S17:NO), it is determined whether the SET key 72 is pressed (Sl9), whether the start/stop switch 12 (see FIG. 1) is pressed to start sewing (S21), and then whether another key is pressed (S23) in order. The processing of S17 through S23 is repeatedly performed until an affirmative determination is detected at any step.

When the PATTERN key 74 is pressed (S17:YES), the flow returns to S7 and the pattern selection screen 60 is displayed. When another key as described above is pressed (S23:YES), the processing corresponding to the function of the pressed key is performed at S25 and then the flow returns to a loop processing of S17 through S23. For example, when the L/S key 73 is pressed, a processing for enlarging or reducing the embroidery pattern is performed.

Figure 9A:
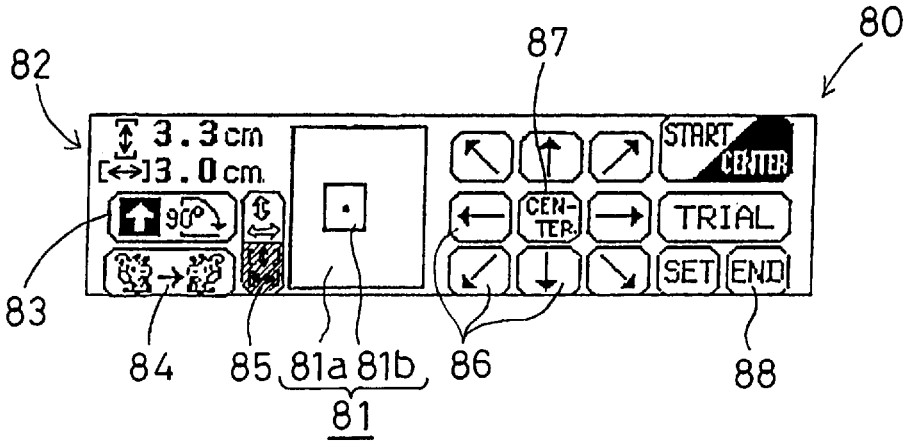
FIG. 9A shows an example of a SET screen.
Figure 9B:
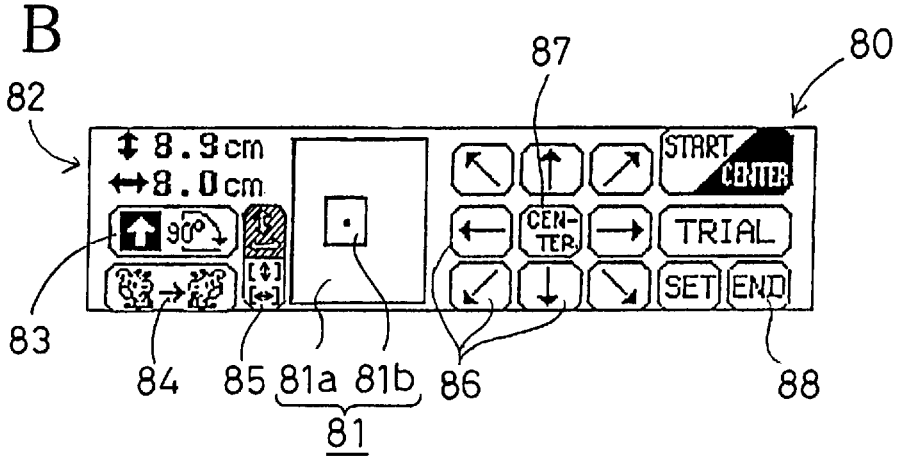
FIG. 9B shows an example of the SET screen.

During the loop processing of S1 7 through S23, when the SET key 72 is pressed (S19:YES), the flow moves to S31 and a SET screen 80, shown in FIG. 9A or 9B, is displayed. The SET screen 80 displays an image display 81 showing a sewing area 81*a*, which corresponds to a work cloth and in which stitches are to be formed on the work cloth, with an outside shape 81*b* in which the embroidery pattern is shaped into a rectangle, a value display area 82 showing the size of the embroidery pattern or the position of the embroidery pattern located on the work cloth in numerical values, a rotation key 83, a flip key 84, a size/position key 85, arrow keys 86, a CENTER key 87, and an END key 88.

At S33, it is determined whether the size/position key 85 is pressed. When the size/position key 85 is not pressed (S33:NO), it is determined as to whether the END key 88 is pressed (S35), and whether another key is pressed (S37) in order. The processing of S33 through S37 is repeatedly performed until an affirmative determination is detected at any step S33, S35, S37.

When the size/position key 85 is pressed (S33:YES), the flow moves to S39. At S39, the display on the SET screen 80 is changed to the size when the position is displayed (FIG. 9B) or is changed to the position when the size is displayed (FIG. 9A). That is, one or the other of the size and position can be displayed on the value display area 82. Therefore, at S39, when the current size is displayed on the value display area 82, the display is changed to the position, and when the position is displayed thereon, the display is changed to the size.

When the size is displayed in the value display area 82, a vertical arrow and a horizontal arrow are each enclosed with brackets, as shown in FIG. 9A. When the position is displayed in the value display area 82, the vertical and horizontal arrows are indicated with a thick line, as shown in FIG. 9B. That is, the value display area 82 shown in FIG. 9A shows the size of the embroidery pattern that "the height is 3.3 cm" and "the width is 3.0 cm". The value display area 82 shown in FIG. 9B shows the center of the embroidery pattern that is positioned 8.9 cm down from the top of the work cloth (sewing area) and 8.0 cm right from the left of the work cloth (sewing area).

The size/position key 85 has individual luminous areas on the upper half and lower half thereof and the arrows showing the size display and the position display are indicated in the upper and lower half of the luminous areas, respectively. While the values for the position are displayed in the value display area 82, the luminous area of the size/position key 85 indicated with the arrows corresponding to the size illuminates, as shown in FIG. 9B. While the values for the size are displayed in the value display area 82, the luminous area of the size/position key 85 indicated with the arrows corresponding to the position illuminates, as shown in FIG. 9A.

After the processing of S39 is performed, the flow returns to the loop processing of S33 through S37 again. When the END key 88 is pressed during the loop processing (S35:YES), the flow returns to S15 to display the pattern display screen 70 and then the flow moves to the loop processing of S17 through S23. When another key is pressed during the loop processing of S33 through S37 (S37:YES), the processing corresponding to the function of the pressed key is performed (S41) and the flow returns to the loop processing of S33 through S37. For example, when the rotation key is pressed, a processing for rotating the embroidery pattern 90 degrees is performed. When the flip key 84 is pressed, a processing for flipping the embroidery pattern from side to side is performed. When the arrow key 86 is pressed, a processing for moving the position of the outside shape 81*b* in the direction indicated by the arrow is executed. When the CENTER key 87 is pressed, processing for moving the outside shape 81*b* to the center of the sewing area 81*a* occurs.

If the rotation key 83 is pressed while the values representing the size are displayed in the value display area 82, the values of vertical and horizontal directions change places in accordance with the key operation. If the arrow key 86 or the CENTER key 87 is pressed while the values representing the position are displayed in the value display area 82, the values change in accordance with the key operation.

On the other hand, when a command to start the sewing operation is issued during the loop processing of S17 through S23 (S21:YES), the flow moves to S43, and a processing for starting the motors 17, 18, 19, 33, 34 is performed. Then, a sewing processing for driving the motors 17, 18, 19, 33, 34 based on the sewing data (see FIG. 3) is performed. At S47, it is determined whether a command to stop the sewing operation is issued because of the completion of the sewing of the embroidery pattern or by pressing the start/stop switch 12. When the command to stop the sewing operation is not issued (S47:NO), the flow returns to S45 and the sewing processing is continued. When the command to stop the sewing operation is issued (S47:YES), a processing for stopping the motors 17, 18, 19, 33, 34 is performed (S49) and then the flow moves to the loop processing of S17 through S23. According to the processing described above, the embroidery sewing machine M of the embodiment can sew a desired embroidery pattern at a desired position on a work cloth.

As described above, in the aforementioned embodiment, the value display area 82 can display either the size or the position of the embroidery pattern, as desired, by pressing the size/position key 85. Further, because the display can be changed as described above, an area for displaying both size and position at one time need not be provided on the LCD 10. Therefore, even though the LCD 10 is smaller in size, as shown in FIG. 1, the size and position of the embroidery pattern can be displayed on the LCD 10 as desired. Consequently, in the aforementioned embodiment, the convenience of the LCD 10 can be secured while the embroidery sewing machine M becomes compact.

In the aforementioned embodiment, according to the presence or absence of the brackets enclosing the arrows and the thickness of the arrows, it is possible to immediately distinguish the values displayed in the value display area 82 and whether they represent the size or position. Therefore, the display prevents the user from mixing up the values and the operability of the embroidery sewing machine M is enhanced. Further, in the aforementioned embodiment, the values can be distinguished by the illumination of the size/position key 85, so that the operability of the embroidery sewing machine M is further increased.

While the invention has been described in detail with reference to a specific embodiment thereof, it would be apparent to those skilled in the art that various changes and modifications may be made therein without departing from the spirit of the invention.

For example, the values of the size and the position may not be displayed on the same display area in a display device. However, if the display positions of both values at least partially overlap each other, an effect such as downsizing of the LCD 10 can be satisfactorily obtained. If the display positions overlap each other as in the aforementioned embodiment, the effect is further brought to the fore. Further, the values may be distinguished as representing the size or the position, without using the brackets, by displaying both values in the different positions, e.g., on the right and left sides, or in the upper and lower positions. For example, the values representing the position are displayed on the left side and the values representing the size are displayed on the right side. Furthermore, the display on the LCD 10 may be changed to a third display condition where the values representing the size and position are displayed at the same time.

Figure 10A:
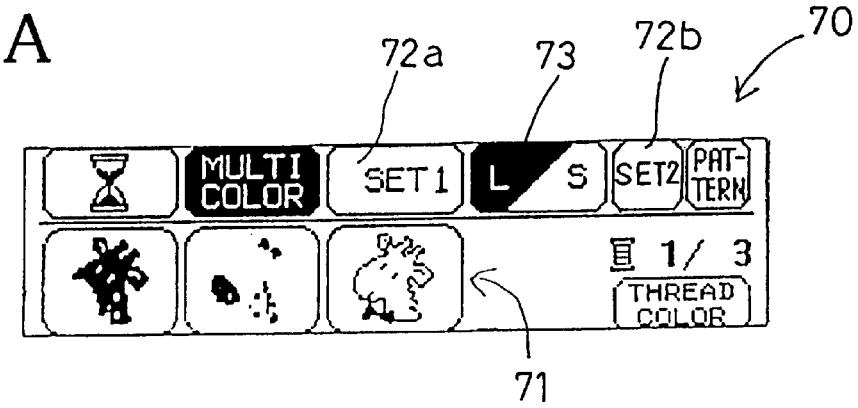
FIG. 10A shows a modification of the pattern display screen.
Figure 10B:
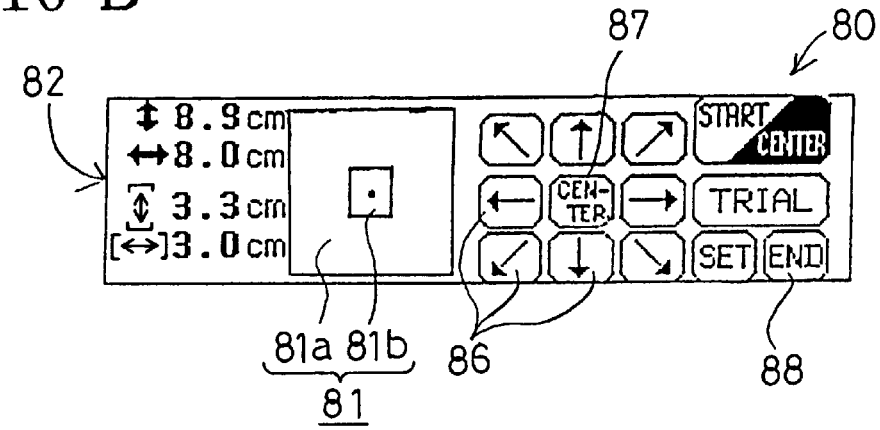
FIG. 10B shows a modification of the SET screen.

FIG. 10A shows a modification of the pattern display screen 70. The modified pattern display screen 70 has a SET 1 key 72*a* which functions in the same manner as the SET key 72 of the principal embodiment. The pattern display screen 70 of FIG. 10A has the same structure as the pattern display screen 70 of FIG. 8C except that the pattern display screen of FIG. 10A has a SET key 2 to be described below. When the SET 1 key 72*a* is pressed, as described above, the SET screen 80 shown in FIG. 9A or 9B appears and the same operation as the aforementioned embodiment can be performed therefrom. When the SET 2 key 72*b* is pressed, the SET screen 80 shown in FIG. 10B is displayed on the LCD 10.

On the SET screen 80, a large value display area 82 is secured using the area where the rotation key 83 and the flip key 84 are displayed, without displaying those keys, to display the values representing the position and size of an embroidery pattern at one time. Therefore, the invention can effectively cope with the case where a user desires to see the position and size of the embroidery pattern at the same time, and the convenience of the LCD 10 can be further increased. As a method for displaying both values at one time, the numbers representing those values may be reduced in size. However, in this case, an LCD having a high resolution is required to display such small numbers and the visibility of the values may become low. As opposed to this, in this embodiment, the values are displayed using the area where the rotation key 83 and the flip key 84 are displayed, so that the area for the display of each value and high visibility of the values is obtained.

In each embodiment described above, the LCD 10 is structured as a touch panel where various commands can be entered. However, the invention can be applied to a display device that only displays an embroidery pattern. When a display device is structured as a touch panel, various commands can be entered by touching keys (buttons) displayed on the touch panel with a finger. Therefore, the operability of the embroidery sewing machine is further increased and the embroidery sewing patterns can be made small, compared with the case when a device for inputting commands is separately provided.

What is claimed is:

1. A sewing machine, comprising:

a sewing device that forms a stitch on a work cloth;

a moving mechanism that moves the work cloth relative to the sewing device;

a display that displays a pattern; and a display switching device that switches the display between a first display mode and a second display mode; a size value that represents a size of the pattern being displayed in the first display mode, a position value that represents a position of the pattern on the work cloth being displayed in the second display mode.

2. The sewing machine according to claim 1, wherein the size value and the position value are displayed on substantially a same part of the display.

3. The sewing machine according to claim 1, wherein the display displays a distinguishable mark along with at least one of the size value or the position value so that the size value and the position value can be distinguished.

4. The sewing machine according to claim 1, wherein the display switching device further switches the display to a third display mode, with both the size value and the position value displayed on the display in the third display mode.

5. The sewing machine according to claim 4, wherein the display comprises a touch key panel, at least one button key is displayed on a predetermined area of the touch key panel, the size value and the position value are displayed on the predetermined area without displaying the button key in the third display mode.

6. A method of displaying pattern data on a limited size display of a sewing machine, comprising:

displaying a pattern selection screen on the display;

selecting a pattern; and displaying the selected pattern on the display in one of a first mode and a second mode, wherein the first mode display includes pattern size data as a size value including height and width of the selected pattern and the second mode display includes position data of the selected pattern relative to a sewing area as a position value comprising a distance from a center of the selected pattern to at least two sides of the sewing area.

7. The method according to claim 6, wherein display in both the first mode and the second mode divide the display into a common key section, a sewing area section and a value display section.

8. The method according to claim 7, wherein the value display section includes a value area, a pattern manipulation key area, and a value switch key, the method further comprising using the value switch key to switch between display of position data and display of size data in the value area.

9. The method according to claim 8, wherein the value area and the value switch key contain identification data to identify a type of value data displayed.

10. The method according to claim 8, further comprising displaying the selected pattern in a third mode, wherein the value area is expanded to completely encompass the value display section and both the position data and the size data are simultaneously displayed.

11. A storage medium containing programs for the display of pattern data on a limited size display of a sewing machine, comprising:

a program for displaying a pattern selection screen on the display;

a program for selecting a pattern; and a program for displaying the selected pattern on the display in one of a first mode and a second mode, wherein the first mode display includes pattern size data as a size value including height and width of the selected pattern and the second mode display includes position data of the selected pattern relative to a sewing area as a position value comprising a distance from a center of the selected pattern to at least two sides of the sewing area.

12. The storage medium according to claim 11, wherein the program for display in both the first mode and the second mode includes a sub-routine for dividing the display into a common key section, a sewing area section and a value display section.

13. The storage medium according to claim 12, wherein the sub-routine for dividing the display creates the value display section to include a value area, a pattern manipulation key area, and a value switch key, the storage medium further including a program using the value switch key to switch between a display of position data and display of size data in the value area.

14. The storage medium according to claim 13, further comprising a sub-routine display in the value area, and as part of the value switch key, identification data to identify a type of value data displayed.

15. The storage medium according to claim 13, further comprising a program for displaying the selected pattern in a third mode, wherein the value area is expanded to completely encompass the value display section and both the position data and the size data are simultaneously displayed.

* * * * *